US007624862B1

(12) United States Patent
Pleggenkuhle

(10) Patent No.: US 7,624,862 B1
(45) Date of Patent: Dec. 1, 2009

(54) CHAINSAW CARRIER

(76) Inventor: Patrick Pleggenkuhle, 2609 280th St., Fredericksburg, IA (US) 50630

( * ) Notice: Subject to any disclaimer, the term of this patent is extended or adjusted under 35 U.S.C. 154(b) by 610 days.

(21) Appl. No.: 10/906,372

(22) Filed: Feb. 16, 2005

Related U.S. Application Data

(60) Provisional application No. 60/552,415, filed on Mar. 10, 2004.

(51) Int. Cl.
*A45C 11/26* (2006.01)

(52) U.S. Cl. ..... 206/349

(58) Field of Classification Search ..... 206/349, 206/207, 303, 304, 348, 493, 525; 248/309.1; 33/202, 712; 30/151, 298.4, 383–387; 83/818, 83/819, 816, 817
See application file for complete search history.

(56) References Cited

U.S. PATENT DOCUMENTS

| | | | | |
|---|---|---|---|---|
| 1,728,106 | A | 9/1929 | Collins | |
| 2,241,979 | A * | 5/1941 | Case | 33/712 |
| 3,559,852 | A * | 2/1971 | Green | 223/96 |
| 4,593,839 | A * | 6/1986 | Vandoros | 223/63 |
| 4,738,165 | A * | 4/1988 | Gelman | 76/36 |
| 4,739,909 | A * | 4/1988 | Bury | 223/15 |
| 4,746,040 | A * | 5/1988 | Hazenveld | 223/96 |
| 4,805,889 | A * | 2/1989 | Liepse | 269/210 |
| 4,872,469 | A * | 10/1989 | Schultz | 135/69 |
| 4,905,948 | A | 3/1990 | Indorf | |
| 5,425,444 | A | 6/1995 | Chapman | |
| 5,597,099 | A * | 1/1997 | Sharp | 223/61 |
| D439,158 | S | 3/2001 | Forakis | |
| 6,942,094 | B2 * | 9/2005 | Coulson | 206/315.1 |

FOREIGN PATENT DOCUMENTS

DE 20015178 U1 * 1/2001

* cited by examiner

*Primary Examiner*—Ehud Gartenberg
*Assistant Examiner*—Ernesto A Grano
(74) *Attorney, Agent, or Firm*—McKee, Voorhees & Sease, P.L.C.

(57) ABSTRACT

A chainsaw blade carrier includes a first piece and a second piece having U-shaped outer grooves that form an outer perimeter for a chainsaw blade. A connecting member joins the first piece and the second piece and is moveable between an extended position and a retracted position. The first piece, second piece and connecting member together forming a structure that approximates the length and width of a chainsaw guide upon a chainsaw. The first and second pieces may be removable between a retracted position and an extended position to place and remove a chainsaw blade upon the outer perimeter. The method of using a chainsaw blade carrier includes the steps compressing the chainsaw blade carrier connecting member to the retracted position, positioning a chainsaw blade upon the outer perimeter, and permitting the chainsaw blade carrier to return to the extended position.

5 Claims, 2 Drawing Sheets

CHAINSAW CARRIER

CROSS-REFERENCE TO RELATED APPLICATIONS

This application is a conversion of U.S. Provisional Application No. 60/552,415, filed Mar. 10, 2004, which is herein incorporated by reference in its entirety.

BACKGROUND OF THE INVENTION

The invention generally relates to storage devices for continuous loop chains and specifically to a chainsaw blade carrier. A chainsaw blade is a continuous loop chain having both chain links and cutter links. The chainsaw blade goes upon a guide bar of a chainsaw.

Typically, chainsaw blades are shipped in plastic bags and are very difficult to unwind. Chainsaw blades are difficult to unwind because the individual links of a chainsaw blade are easily kinked once off the chainsaw guide bar. When the chainsaw blade is stored in a. Ziploc bag they are typically intentionally kinked and coiled to be placed in a small volume space. The chainsaw blades are also difficult to unwind because they are very sharp. Even a chainsaw blade that is dull from use is still hazardous to the user. Of course, the cutting links, when sharpened will easily lacerate the user's fingers. The user must typically use gloves to unkink and return the chainsaw blade to a one loop configuration so that it may then be placed on a chainsaw.

Therefore, a primary objective of the present invention is to provide a chainsaw blade carrier that stores chainsaw blades without kinks and thus limits the risk of injury to the user.

As chainsaw blades are typically shipped in plastic bags, chainsaw blade carriers have not been made which mimics the shape of a chainsaw blade holder or guide bar on a chainsaw. A chainsaw blade carrier with this feature would permit the user an easily recognizable storage place for chainsaw blades. In addition, such a chainsaw blade guide bar shape would permit the user to sharpen the blade on the carrier as opposed to on the chainsaw itself.

Therefore, a further objective of the present invention is the design of a chainsaw blade carrier that is shaped as a chainsaw blade holder.

In addition, a still further objective of the present invention is a chainsaw blade carrier that permits sharpening of the chainsaw blade while on the carrier.

Chainsaw blades come in a variety of different sizes. Chainsaw blades are typically sized to a chainsaw guide bar. Chainsaw guide bars typically range from 12 inches in length to 24 inches in length. Therefore, a still further objective of the present invention is a chainsaw carrier that may be expanded to accommodate a wide range of chainsaw lengths and still keep them secured for storage and transportation.

In addition, chainsaw blade carriers would benefit from a groove in the outer perimeter of the carrier to prevent inadvertent release of the chainsaw blade from the carrier. Therefore, a still further objective of the present invention is the inclusion of a groove in the outer perimeter of the carrier.

A still further objective of the present invention is the provision of a chainsaw blade carrier that is easy to use and efficient and economical to manufacture.

These and other objectives will become apparent from the following specification and figures.

DETAILED DESCRIPTION OF THE PREFERRED EMBODIMENT

Figure 1:
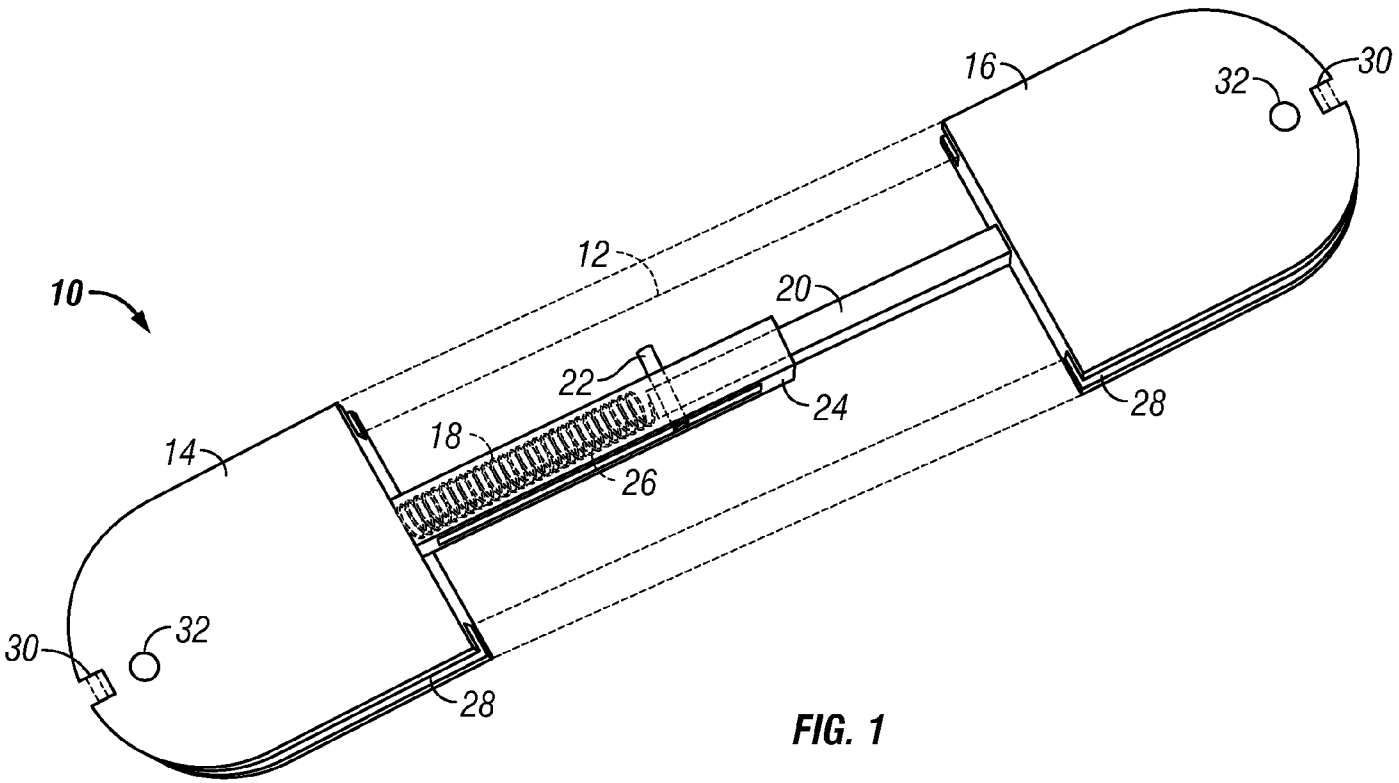
FIG. 1 is a perspective view of the chainsaw blade carrier of the present invention.

Referring to the figures, a chainsaw blade carrier is generally referred to as numeral 10. The carrier 10 is designed to maintain a chainsaw blade in an untangled condition on the outside perimeter 12 of the chainsaw blade carrier 10. The chainsaw blade carrier 10 has a first piece 14 and a second piece 16 connected by a hollow tube 18 that receives rod 20. The hollow tube 18 is connected to rod 20 by pin 22. The pin 22 extends beyond the hollow tube 18 sides such that it cannot pass beyond an obstruction 24 at the end of the hollow tube 18. A spring 26 biases the rod 20 and second piece 16 away from the first piece 14 and hollow tube 18. The biasing force of the spring 26 is counteracted by an opposite force by the chainsaw blade (not shown) to hold the blade taut in the carrier 10.

The carrier 10 also has a groove 28 on the outside edge of the first piece 14 and the second piece 16. The chain sits within groove 28. The spring 26 may be depressed so that the chainsaw chain may be placed in the grooves 28.

The carrier 10 may also have a notch 30 on either the first piece 14 or on the second piece 16. These notches 30 permit sharpening of the chain without taking the chain out of the carrier 10. The sharpening area or notch 30 is simply an exposed area to permit sharpening of the chain while in the chain carrier 10. The carrier 10 stabilizes the movement of the chain for running a chain file (not shown) through each individual cutting edge of the chain.

In addition, a hole 32 may be located in the first piece 14 or the second piece 16 in order to facilitate vertical hanging of the carrier 10.

Figure 2:
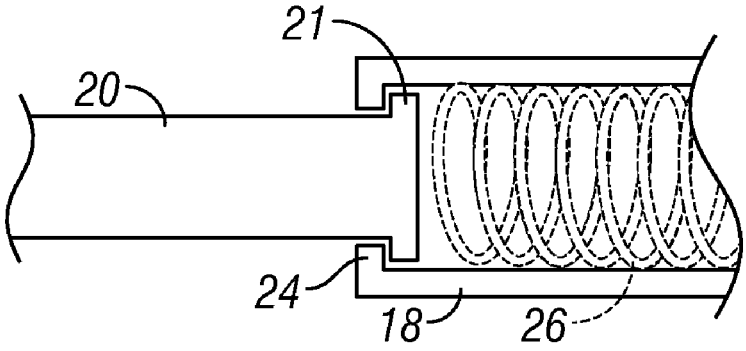
FIG. 2 is an alternate embodiment of the interconnection between the hollow tube and the solid end of the present invention.
Figure 3:
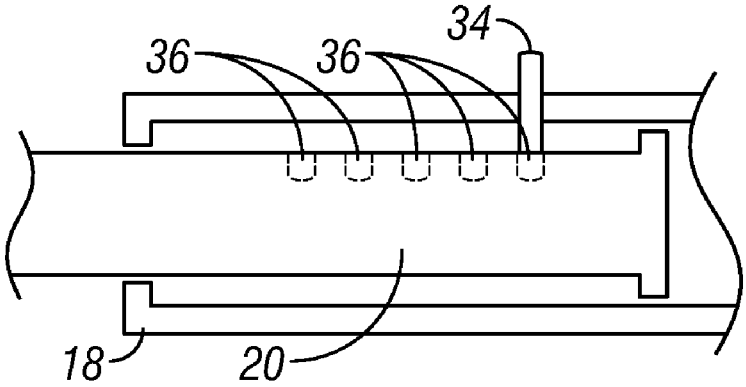
FIG. 3 is a second alternate embodiment of the interconnection between the hollow tube and the solid rod of the present invention.

As seen in FIGS. 2 and 3, the connection between the hollow end 18 and the solid end 20 may be made in several different ways. As seen in FIG. 2, the solid end 20 may have lip 21 that fits within the hollow end 18. The hollow end 18 does not have a channel 19 through which a pin attached to the solid rod 20 travels but rather the lip 21 of the solid rod 20 cooperates directly with spring 26 and at the farthest most point in the hollow tube cooperates with the obstruction 24.

As seen in FIG. 3, the hollow tube 18 may be joined to the rod 20 by a spring loaded button 34 that fits within notches 36 in the solid rod 20. The user can depress the spring loaded button 34 into the hollow tube and then move the solid rod 20 to fit within another hole 36. Therefore, the user can depress the button 34 until the edge of the button is beneath the lower edge of the hole 36 and then move the solid rod to a shorter length so that the chain may be placed within the grooves 28. The button may then be depressed again and the apparatus extended to the longer length so that the chain may be held within the grooves 28.

Numerous other connection means between the hollow tube 18 and the solid rod 20 may be fashioned such that the first piece can move relative to the second piece to place a chain upon the carrier 10 as well as secure the chain to the carrier 10.

A first and second piece are typically four inches wide and five inches long. These lengths are chosen to simulate a chainsaw guide bar and the dimensions may change as long as the general shape of the guide bar is maintained. The depth of the first and second ends is approximately ¾ inches. However, the depth may be altered to hold more than one chainsaw blade or for varying widths of chainsaw chains. The solid rod 20 is approximately a 7/16 inch square. The width of the hollow tube 18 is slightly larger than the 7/16 inch square solid rod. The depth of the solid rod 20 and hollow tube 18 combination is preferably equal to or less than the depth of the first and second pieces 14, 16. The width of the hollow tube 18 may vary from structure to structure depending upon design preferences as well as utility preferences of the combination of the hollow tube 18 and the shaft 20.

The groove 28 as seen in FIG. 1 may be V-shaped to keep the chain from moving. Alternatively, the groove can be U-shaped or square shaped. Alternatively, the groove can be any shape that maintains the chain secured within the groove.

It should be apparent that various modes of carrying out this invention are contemplated, as are various modifications of the method of use. Whereas the invention has been shown and described in connection with the preferred embodiments thereof, it will be understood that many modifications, substitutions, and additions may be made which are within the intended broad scope of the invention. From the foregoing, it can be seen that the present invention accomplishes at least all of the above stated objectives and maintains the chain in an unkinked state so that it may be shipped and stored. It should be clear that chain can be held in a stationary and manageable position while sharpening and thereafter protect the cutting surfaces from dulling.

What is claimed is:

1. A chainsaw blade carrier for storing a chainsaw blade without kinks, comprising:

a first U-shaped piece and a second U-shaped piece opposite the first piece, and each having a curved outer end and opposite parallel sides;

a groove extending along the outer ends and opposite sides of each piece to receive the chainsaw blade, and being U-shaped with opposite parallel sides;

telescoping members between the first piece and the second piece moveable between an extended position and a retracted position;

the first and second telescoping members having opposite outer ends to which the first and second U-shaped pieces are fixed, respectively, without relative movement between each U-shaped piece and the telescoping member fixed thereto, and the telescoping members having inner ends which are slidably coupled for movement between the extended and retracted positions;

the telescoping members having engaging elements to prevent uncoupling of the members;

the first and second U-shaped pieces having a width substantially greater than the telescoping members such that the groove is laterally spaced apart from the telescoping members;

a spring to bias the telescoping members to the extended position;

a chainsaw blade extending around the first and second U-shaped pieces and residing in the groove and spaced laterally apart from the telescoping members; and a notch formed in the first piece and extending through the groove and through the opposite sides of the first piece to expose a cutting portion of the chainsaw blade for sharpening by a tool passing through the notch and both sides of the first U-shaped piece.

2. The chainsaw blade carrier of claim 1 wherein the notch is perpendicular to the groove.

3. The chainsaw blade carrier of claim 1 wherein the engaging elements include a pin and a groove to slidably receive the pin.

4. The chainsaw blade carrier of claim 1 wherein the engaging elements include overlapping lips.

5. The chainsaw blade carrier of claim 1 wherein the engaging elements include a pin and a plurality of sockets to selectively receive the pin.

* * * * *

UNITED STATES PATENT AND TRADEMARK OFFICE

CERTIFICATE OF CORRECTION

PATENT NO. : 7,624,862 B1
APPLICATION NO. : 10/906372
DATED : December 1, 2009
INVENTOR(S) : Patrick Pleggenkuhle It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 772 days.

Signed and Sealed this

Twenty-sixth Day of October, 2010

David J. Kappos

David J. Kappos
*Director of the United States Patent and Trademark Office*